US012538970B2

(12) United States Patent
Randall-Green et al.

(10) Patent No.: US 12,538,970 B2
(45) Date of Patent: Feb. 3, 2026

(54) ALL-IN-ONE MULTI-PURPOSE COSMETIC DEVICE WITH INTERCHANGEABLE AND REPLACEABLE COSMETIC COMPONENTS

(71) Applicants: Shardae Angelique Randall-Green, Raleigh, NC (US); Nevaeh Marie Randall-Sickles, Raleigh, NC (US); Kylie Samantha Bowling, Albuquerque, NM (US); Deirdre Ann Wallace-Hente, Albuquerque, NM (US); Islarose Fiona Wallace-Hente, Albuquerque, NM (US)

(72) Inventors: Shardae Angelique Randall-Green, Raleigh, NC (US); Nevaeh Marie Randall-Sickles, Raleigh, NC (US); Kylie Samantha Bowling, Albuquerque, NM (US); Deirdre Ann Wallace-Hente, Albuquerque, NM (US); Islarose Fiona Wallace-Hente, Albuquerque, NM (US)

(73) Assignees: Shardae Randall-Green, Angier, NC (US); Nevaeh Randall-Sickles, Angier, NC (US); Deirdre Wallace-Hente, Albuquerque, NM (US); IslaRose Wallace-Hente, Albuquerque, NM (US); Angela Randall, Lillington, NC (US)

( * ) Notice: Subject to any disclaimer, the term of this patent is extended or adjusted under 35 U.S.C. 154(b) by 305 days.

(21) Appl. No.: 18/112,606

(22) Filed: Feb. 22, 2023

(65) Prior Publication Data

US 2023/0346107 A1 Nov. 2, 2023

Related U.S. Application Data

(60) Provisional application No. 63/312,875, filed on Feb. 23, 2022.

(51) Int. Cl.

| | |
|---|---|
| ***A45D 40/24*** | (2006.01) |
| ***A45D 40/00*** | (2006.01) |
| ***A45D 40/26*** | (2006.01) |

(52) U.S. Cl.

CPC ..... *A45D 40/24* (2013.01); *A45D 40/265* (2013.01); *A45D 2040/0006* (2013.01); *A45D 2200/1018* (2013.01); *A45D 2200/25* (2013.01)

(58) Field of Classification Search

CPC ..... A45D 40/00; A45D 40/24; A45D 2040/0006; A45D 2200/1018;

(Continued)

(56) References Cited

U.S. PATENT DOCUMENTS 3,188,157 A * 6/1965 Rand ..... A47B 87/0292 220/23.8
4,807,773 A * 2/1989 Tsai ..... A45D 33/24 206/823

(Continued)

OTHER PUBLICATIONS

Screenshot for product on Amazon "Nymph Makeup Kit for Teens . . . ", accessed/dated Nov. 28, 2023.

(Continued)

*Primary Examiner* — Rachel R Steitz
*Assistant Examiner* — Karim Asqiriba
(74) *Attorney, Agent, or Firm* — CASTELLANO PLLC

(57) ABSTRACT

Provided are all-in-one cosmetic device systems with interchangeable and replaceable cosmetic components that include a bottom cover cosmetic brush cleansing pad; a bottom cosmetic storage compartment over the bottom cover cosmetic brush cleansing pad, which bottom cosmetic storage compartment is configured to hold at least one cosmetic component selected from the group consisting of eyeliner, lip liner, lip gloss, mascara and foundation; one or more upper cosmetic compartments over said bottom cosmetic storage compartment, which can each rotate into an open (Continued)

position, to reveal at least one cosmetic component and/or applicator therein, which allows a user to access said at least one cosmetic component and/or applicator; a cosmetic sponge over the top of the one or more upper cosmetic compartments; a cosmetic brush within a retractable sheath over the cosmetic sponge; and a top cover fitted over the cosmetic brush when the cosmetic brush is in a retracted position.

12 Claims, 17 Drawing Sheets

(58) Field of Classification Search
CPC .... A45D 2200/25; A45D 27/22; A45D 29/20; A45D 33/16; A45D 33/18; A45D 33/20; A45D 33/22; A45D 33/26; A45D 33/28; A45D 34/06; A45D 40/18
See application file for complete search history.

(56) References Cited

U.S. PATENT DOCUMENTS 4,815,483 A * 3/1989 DuGrenier ..... A45D 33/28 206/229
4,944,402 A * 7/1990 Wu ..... A45D 40/22 220/4.27
5,246,020 A * 9/1993 Wu ..... A45D 33/24 206/823
6,041,935 A * 3/2000 Yang ..... A45D 40/22 220/4.27
6,145,515 A * 11/2000 Wu ..... A45D 40/24 132/294
6,200,045 B1 * 3/2001 Hahn ..... A45D 34/06 401/126
2002/0108628 A1 * 8/2002 Sheng ..... A45D 33/20 D28/80
2002/0179485 A1 * 12/2002 Shih ..... A45D 40/24 206/581
2008/0145133 A1 * 6/2008 Palmer ..... B65D 21/0231 401/18
2009/0293905 A1 * 12/2009 Albert ..... A45D 33/28 132/297
2018/0199690 A1 * 7/2018 Steele ..... A45D 33/006
2020/0146422 A1 * 5/2020 Kamboj ..... A45D 40/16
2020/0288840 A1 * 9/2020 Al-Sulatieen ..... A45D 42/00
2022/0240643 A1 8/2022 Suwanto et al.
2023/0210238 A1 * 7/2023 Caspi ..... A45D 34/00 427/429
2023/0218061 A1 7/2023 Sobol et al.

OTHER PUBLICATIONS

Screenshot for product on Amazon "Beau All In One Makeup Gift Kit . . . ", accessed/dated Nov. 28, 2023.
Screenshot for product on Amazon "Duer Lika Carry All in One Trunk Train Case with Makeup . . . ", accessed/dated Nov. 28, 2023.
Screenshot for product on Amazon "wet n wild Scooby Doo Limited Edition PR Box-Makeup Set with Brushes, and Palettes . . . ", accessed/dated Nov. 28, 2023.
Screenshot for product on Amazon "Maepeor All in One Makeup Kit . . . ", accessed/dated Nov. 28, 2023.

* cited by examiner

ALL-IN-ONE MULTI-PURPOSE COSMETIC DEVICE WITH INTERCHANGEABLE AND REPLACEABLE COSMETIC COMPONENTS

RELATED APPLICATION

This application claims the benefit of U.S. Provisional Application 63/312,875 filed on Feb. 23, 2022, the contents of which are hereby incorporated herein by reference in its entirety

FIELD

The present invention relates to unique, customizable cosmetic devices with interchangeable and replaceable cosmetic components for storing and carrying makeup.

BACKGROUND

Cosmetics are generally sold as individual pieces that are purchased individually by a buyer.

Cosmetic sets may be sold that include for example, a group or set of cosmetics sold together, which may have a box or palette (for e.g. different shades of eye shadow).

Also known are travel bags or organizers with pouches for individual cosmetic items.

BRIEF SUMMARY OF THE INVENTION

Provided are all-in-one cosmetic devices and device systems, that include all in one system, a case for multiple cosmetics and types of cosmetics, interchangeable and replaceable cosmetic components, applicators, such as brushes and sponges, and detachable cleaning pads for cleaning applicators.

BRIEF DESCRIPTION OF THE DRAWINGS

Non-limiting embodiments of the present invention are demonstrated by virtue of the illustrative Figures herein, which include the following.

DETAILED DESCRIPTION OF THE INVENTION

The present invention provides an all-in-one replaceable, refillable and interchangeable cosmetic device, accessory kit or carrying case, which is unique and offers a significant advantage over other products in the market. Examples of the present invention provide secure and organized systems, devices, kits and methods of carrying all cosmetics used on a daily basis and is customizable to a user. The present invention provides an all-in-one unique cosmetic accessory device, device system and/or kit that carries a complete line of cosmetics and applicators in one organized case. Non-limiting examples provide a bottom cover, which may include a detachable cosmetic brush cleaning or cleansing pad. According to further Examples, the present carrying case or kit may include a pop socket or other mechanism for holding and/or propping up at least one component of the present cosmetic device systems.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language).

The terms "makeup" and "cosmetics" are used interchangeably herein.

The term "see through" is intended to include transparent and partially transparent material. It may include material that has a tinted color or clear, but through which at least some light may pass.

In the examples described and depicted in the attached drawings, the components are as follows. It should be noted however, and would be recognized by those skilled in the art, that the components may be modified within the scope of the present invention.

Figure 1:
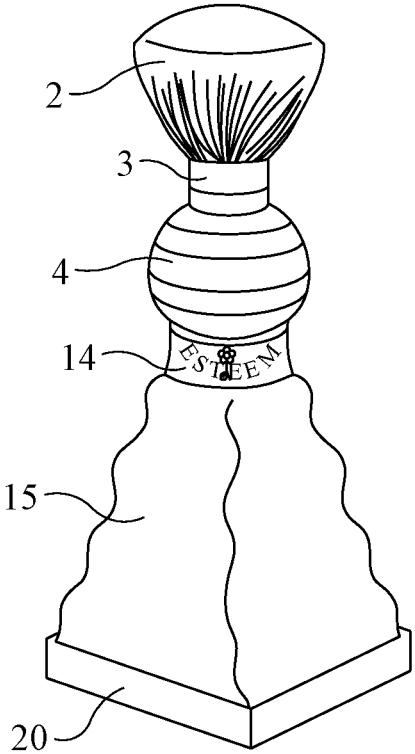
FIG. 1 is a front elevation view of an example cosmetic device in accordance with non-limiting example embodiments of the present invention.
Figure 2:
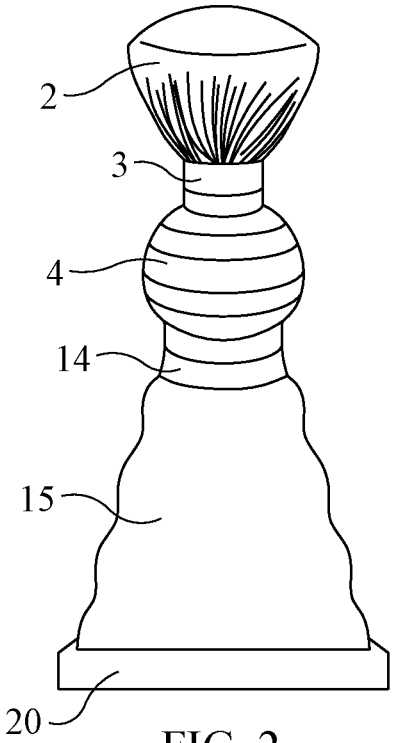
FIG. 2 is a left side elevation view thereof.
Figure 3:
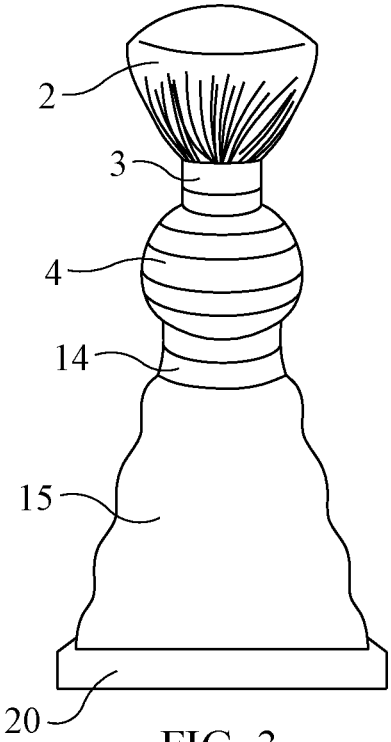
FIG. 3 is a right side elevation view thereof.
Figure 4:
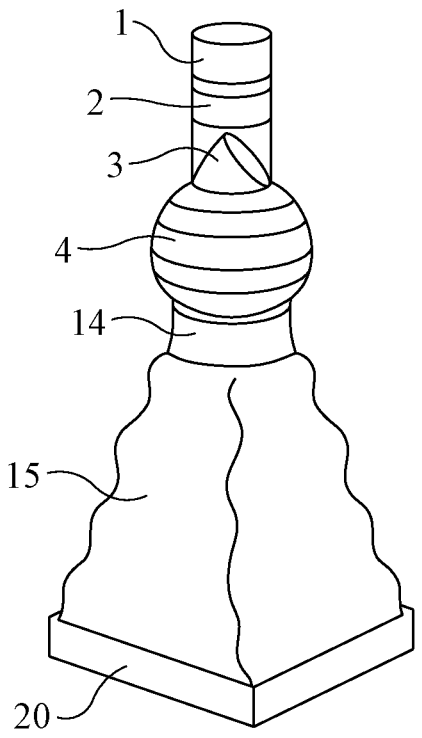
FIG. 4 is a rear elevation view with top cover thereof.
Figure 5:
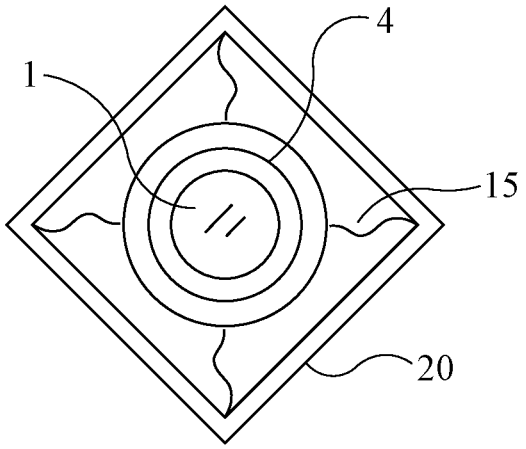
FIG. 5 is a top elevation view with top cover thereof.
Figures 6A, 6B:
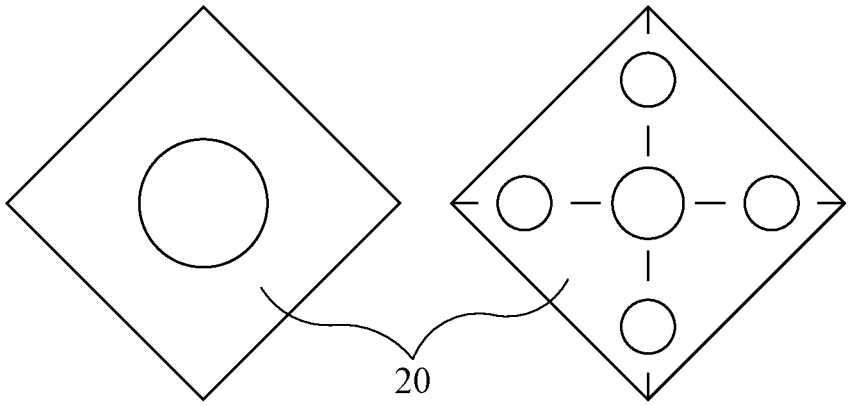
FIGS. 6A and 6B are bottom plan views with and without bottom cover thereof, respectively.
Figure 7:
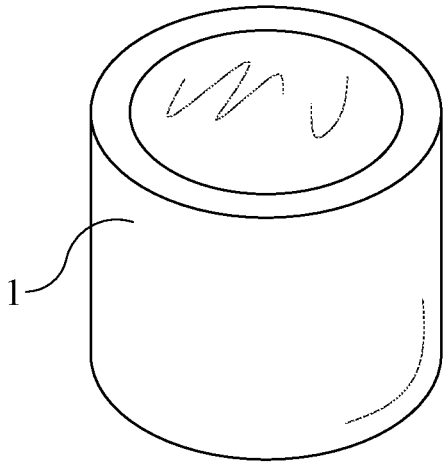
FIG. 7 is a perspective view of a top cover with mirrored finish to a cosmetic brush of cosmetic devices according to example embodiments of the present invention.
Figure 8:
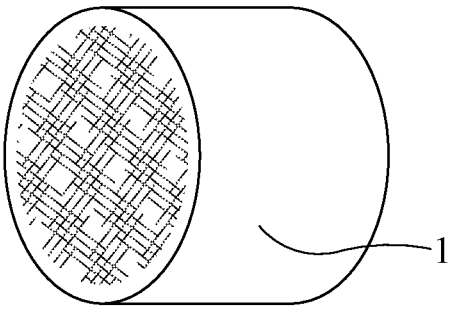
FIG. 8 is a side view of the top cover to the cosmetic brush with a mirrored finish.
Figure 9:
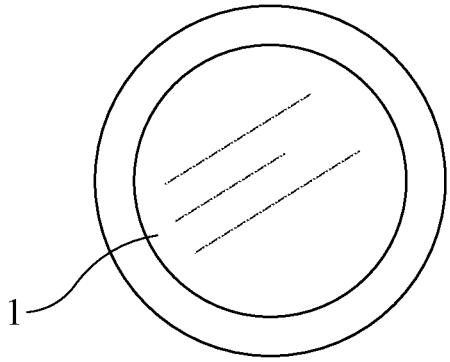
FIG. 9 is a top view of the top cover to the cosmetic brush with a mirrored finish.
Figure 10:
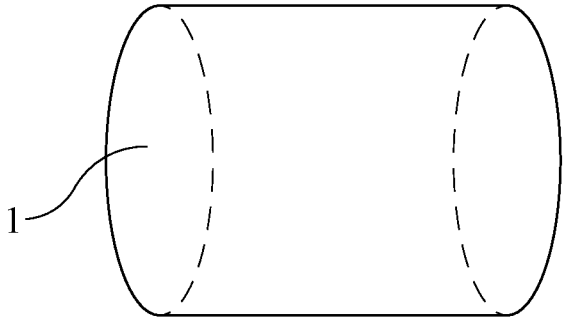
FIG. 10 is a side view of the top cover to the cosmetic brush with a mirrored finish.

1. Top cover
2. Cosmetic brush with sliding sheath
3. Cosmetic sponge with twist in sponge
4. Rotating cosmetic compartments that holds eye shadow, blush, lip color and/or corresponding brushes
5. Blush compartment
6. Blush brush compartment
7. Lip color compartment
8. Lip color brush compartment
9. Eye shadow compartment
10. Eye shadow brush compartment
11. Blush brush
12. Eye shadow brush
13. Lip color brush
14. Foundation compartment pump lid
15. Bottom cosmetic storage compartment
16. Lip liner
17. Eye liner
18. Mascara
19. Lip gloss
20. Removable bottom cover cosmetic brush cleansing pad
21. Foundation compartment
22. Foundation dispensing tube FIGS. 1-6 depict external views from different sides (FIGS. 1-4), the top (FIG. 5) and bottom (FIG. 6) of non-limiting example embodiments of cosmetic devices in accordance with the present invention. FIGS. 1-5, depict, inter alia, an example embodiment that includes a removable bottom cover cosmetic brush cleansing pad 20, a cosmetic storage compartment 15, a brush with a sliding sheath 2, and a sponge 3. FIG. 5 shows a top view of example cosmetic devices according to example embodiments of the present invention. FIGS. 6A and B show example embodiments of the bottom 20 of the accessory system without a removable bottom cover cosmetic brush cleansing pad (6B) and with a cosmetic brush cleansing pad over the bottom of the present device and/or system (6A).

FIGS. 7-10 depict non-limiting example embodiments of a top cover 1 to example embodiments of the present invention, from different angles. According to example embodiments, the top cover may be mirrored, but it is not limited to being mirrored. In embodiments in which the top cover is mirrored, the mirror may be used by a user of the present system/device to assist in applying cosmetics in the system/device. The top cover may be any number of colors or finishes, or it may be white. The top cover may also be opaque or it may be transparent or semi-transparent. The top cover may be configured in size and shape to cover the top of a cosmetic brush 2, such as the brush depicted in FIGS. 11-15, which may be a blush that is used for example for applying blush or powder.

Figure 11:
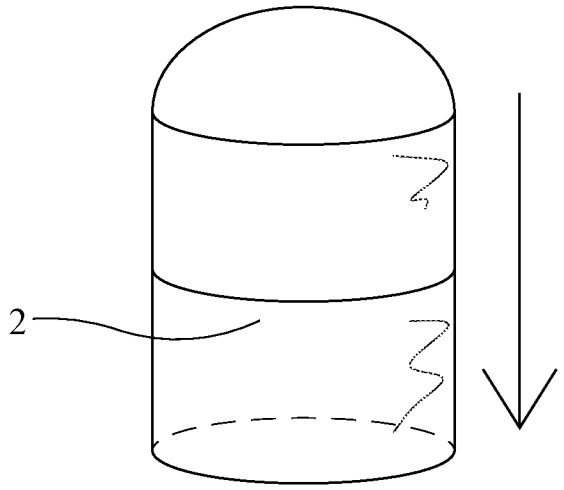
FIG. 11 is a side view of a cosmetic brush with sliding sheath in an up position of cosmetic devices according to example embodiments of the present invention.
Figure 12:
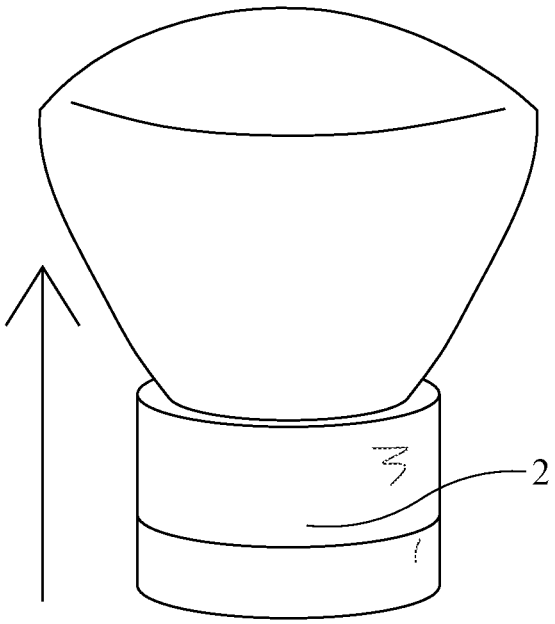
FIG. 12 is a side view of the cosmetic brush with sliding sheath in a down position.
Figure 13:
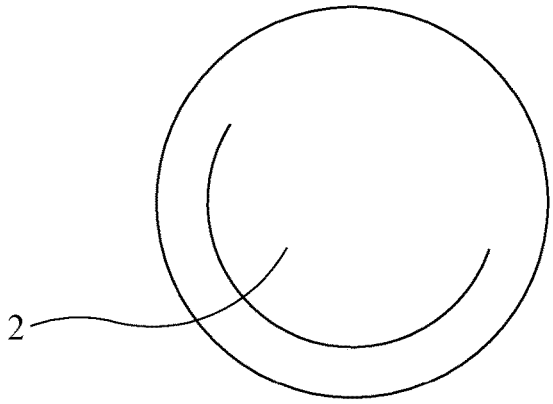
FIG. 13 is a bottom view of the cosmetic brush showing twist on bottom.
Figure 14:
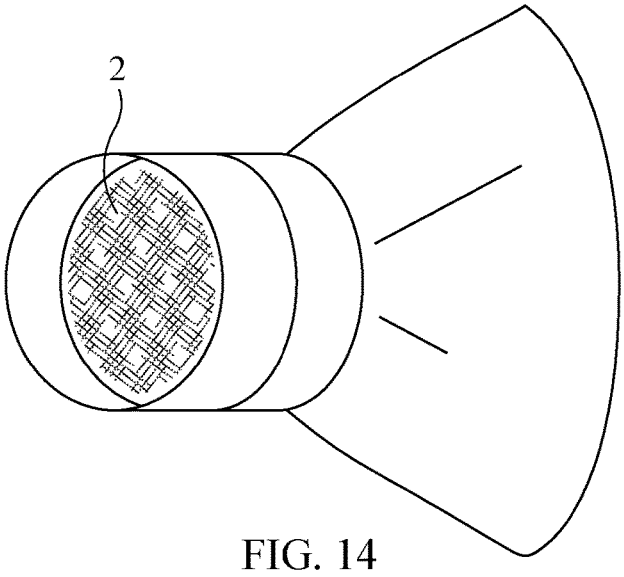
FIG. 14 is a side view of the cosmetic brush with sliding sheath down.
Figure 15:
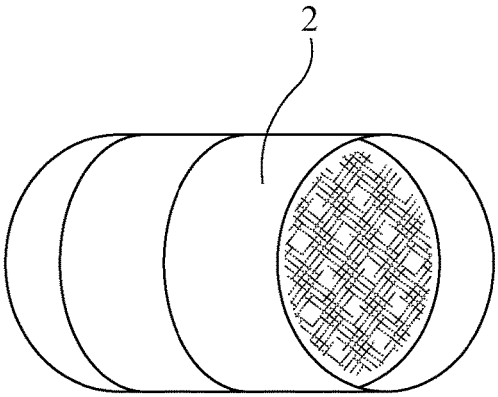
FIG. 15 is a side view of the cosmetic brush with sliding sheath up.

FIGS. 11-15 depict a cosmetic brush 2 within a sliding sheath. FIGS. 11 and 15 show the sliding sheath in the up position, which protects the brush. FIGS. 12 and 14 show a cosmetic brush with the sliding sheath down, i.e., a position in which the cosmetic brush is out for use. The top cover may be applied over the brush when the sliding sheath is in the up position. In this configuration, the top cover may be configured to cover and protect the brush 2. In non-limiting example embodiments, the top cover may be configured to removably attach to the sliding sheath (for example by snapping on or twisting on), to prevent the top cover from falling off the present devices.

FIG. 13 depicts the bottom of a sliding sheath over a blush brush in accordance with non-limiting example embodiments. The sliding sheath may operate in any number of ways that allow it to go up and down or otherwise cover more or less of the brush, to protect the brush in one position, and open the brush up for use in another position. FIG. 13 shoes an embodiment in which a portion of the sliding sheath may be rotated to effectuate a portion of the sheath going up or down depending on which way the sheath is rotated. It is also contemplated that the sliding sheath may be removably locked into a position to prevent the sheath from inadvertently going up or down.

Figure 16:
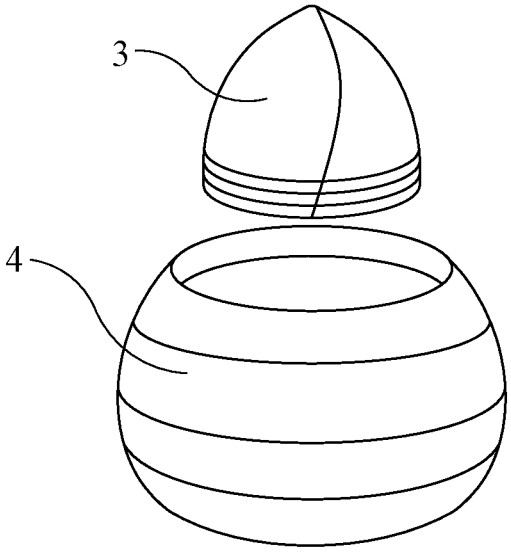
FIG. 16 is a side perspective view of a cosmetic sponge over the top of one or more upper cosmetic compartments according to example embodiments of the present invention.

FIG. 16 is a side view of a cosmetic sponge 3, in accordance with non-limiting examples of the present invention. The embodiment depicted in FIG. 16 shows that the sponge 3 may be a twist in sponge. The sponge may be twisted out to remove it for use and/or for replacement. The same or a different sponge may then be twisted back in to position in the present systems. FIG. 16 also shows upper cosmetic compartments in a closed format.

Figure 17:
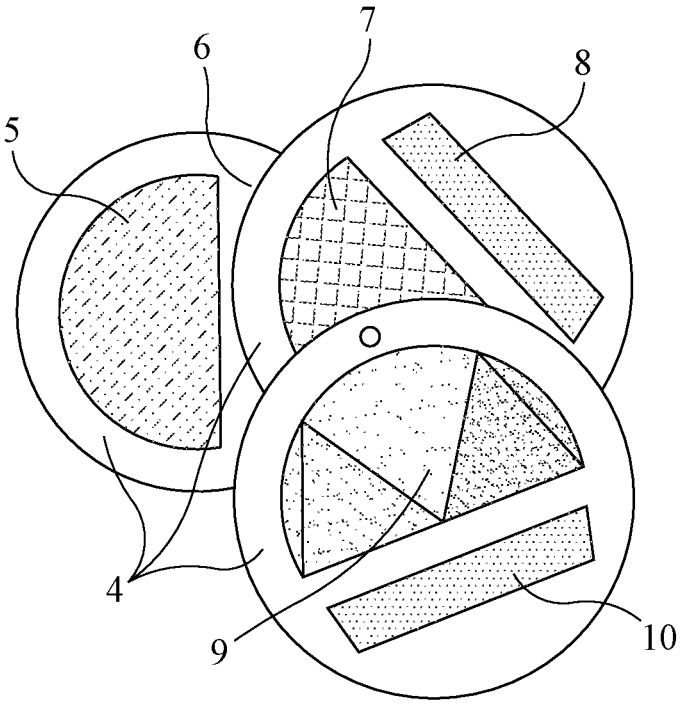
FIG. 17 is a top view of the one or more upper cosmetic compartments in open format.

FIG. 17 shows upper cosmetic compartments in an open format. As shown in FIG. 17, cosmetic insert compartments 4 may be filled by removable, interchangeable or replaceable makeup/cosmetic inserts into compartments 5-10. The shape and size of the compartments and the inserts are not limited in size or shape, but they may be of similar size and shape as each other, so that the inserts may fit within more than one upper compartment, e.g., if a user wants to move cosmetic components to a different location within the system.

According to example embodiments, cosmetic inserts may fit snuggly within the compartments so they do not easily fall out. According to further embodiments, there may be a further mechanism for securing the inserts in the compartments, such as by non-permanent adhesive or hook and loop fastener or by other mechanisms that may be determined by those skilled in the art.

The cosmetic inserts may be predetermined by a manufacturer and included within the device as originally sold, or may be sold separately, or originally included but with separately available replacements. The inserts may be all of one type (such as different eye shadow inserts), or there may be different types of inserts, such as one eye shadow, one blush and one lipstick or other types of cosmetic.

Figure 18:
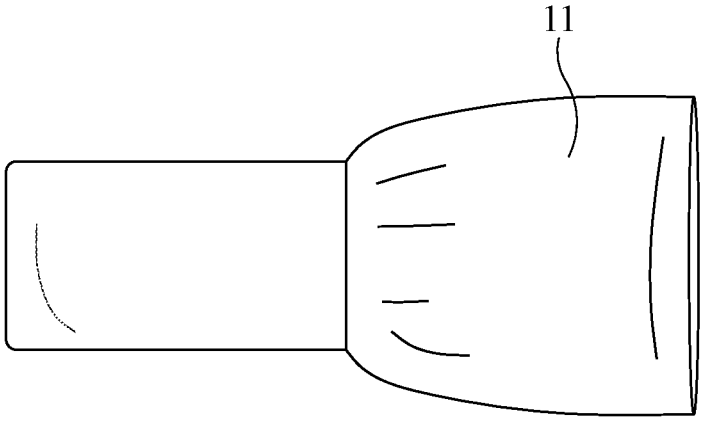
FIG. 18 is a side view of a blush cosmetic brush which may be stored within the blush cosmetic compartment.
Figure 19:
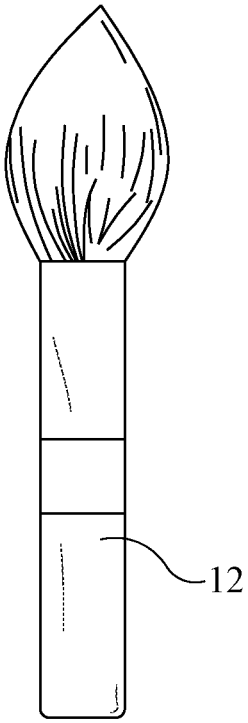
FIG. 19 is a side view of a cosmetic brush.
Figure 20:
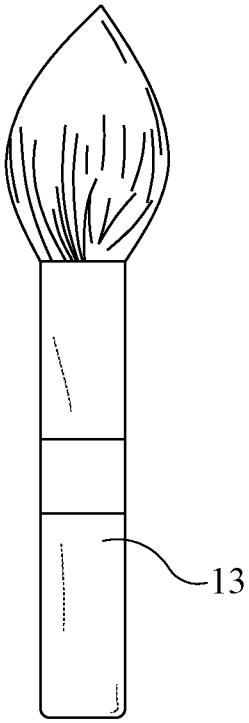
FIG. 20 is a side view of an eye shadow cosmetic brush stored within the eye shadow compartment.
Figure 21:
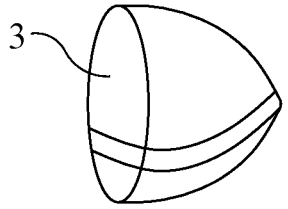
FIG. 21 is a side perspective view of a cosmetic sponge.
Figure 22:
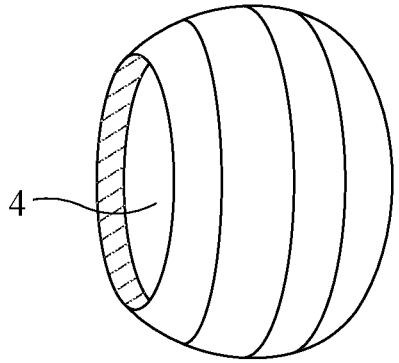
FIG. 22 is a side view of the cosmetic compartments in closed format.

It is also contemplated that the compartments 4 may include fewer than 3, or more than 3 compartments. Each upper compartment 4 may also include an applicator compartment, such as that depicted as the rectangular compartment in FIG. 17. This compartment may be of varying size and shape so long as it is a shape suitable for holding a desired applicator, such as a brush as depicted e.g., in FIGS. 18-20. FIG. 18 shows a blush brush 11. FIG. 19 shows an eye shadow cosmetic brush 12, and FIG. 20 shows a lip brush 13. According to example embodiments, a brush may be for example in the same upper compartment 4 as the cosmetic it corresponds with.

According to example embodiments, the cosmetic sponge 3 may be detachably attached to the compartments 4, such that sponge may be replaced after its useful life.

Figure 23:
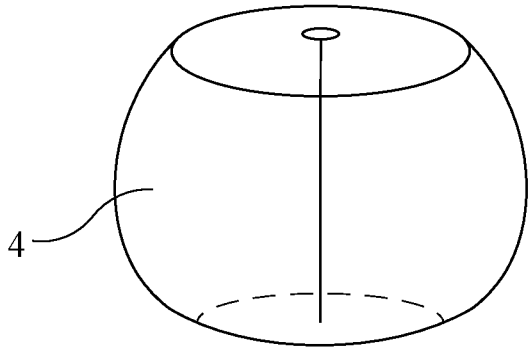
FIG. 23 is a side see-through view of the one or more upper cosmetic compartments in closed format with a securing pin, about which the upper cosmetic compartments may rotate to open them up for use.
Figure 24:
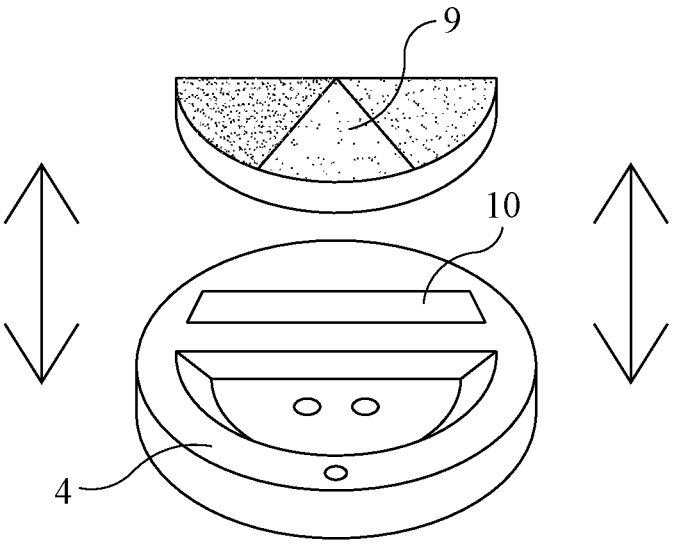
FIG. 24 is a top angled view of an upper cosmetic compartment, representing the interchangeable makeup parts.
Figure 25:
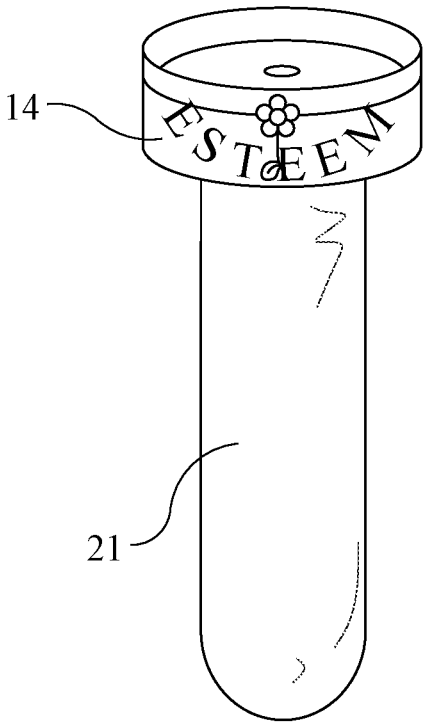
FIG. 25 is a side view of a foundation compartment with lid according to example embodiments of the present invention
Figure 26:
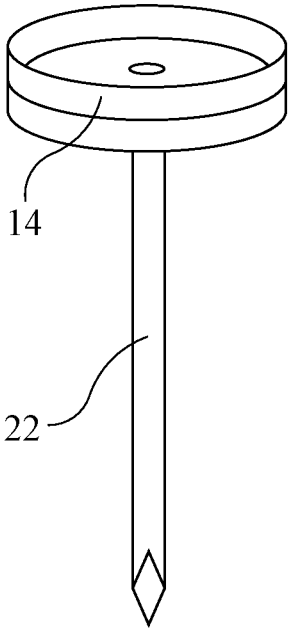
FIG. 26 is a side view of a pump action dispenser tube for insertion into the foundation compartment.
Figure 27:
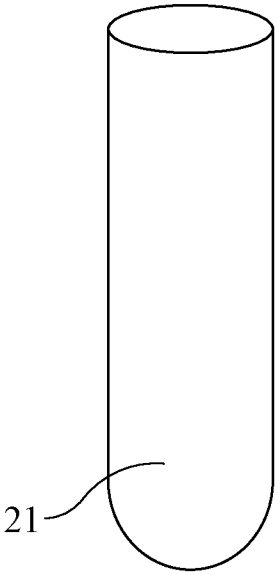
FIG. 27 is a side view of the container of the foundation compartment.
Figure 28:
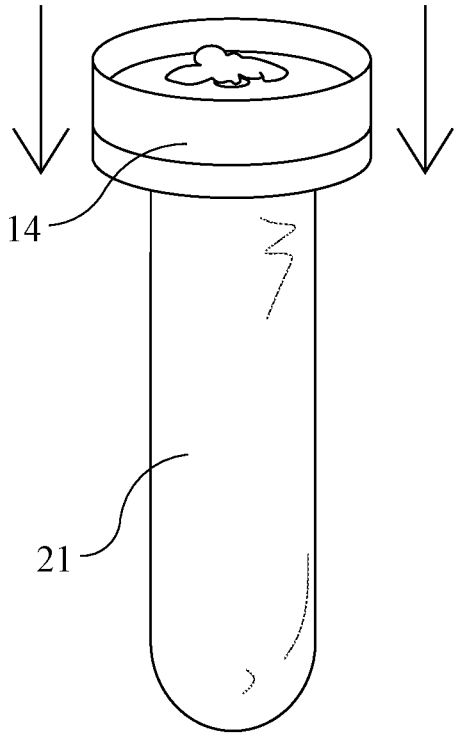
FIG. 28 is a side view of the foundation container with pump action dispenser depicted.
Figure 29:
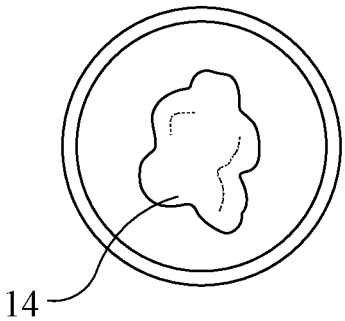
FIG. 29 is a top view of a lid of the foundation compartment.
Figure 30:
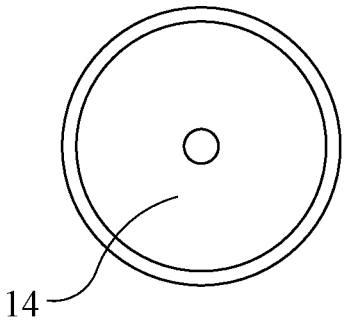
FIG. 30 is a top view of the pump action dispenser tube.
Figure 31:
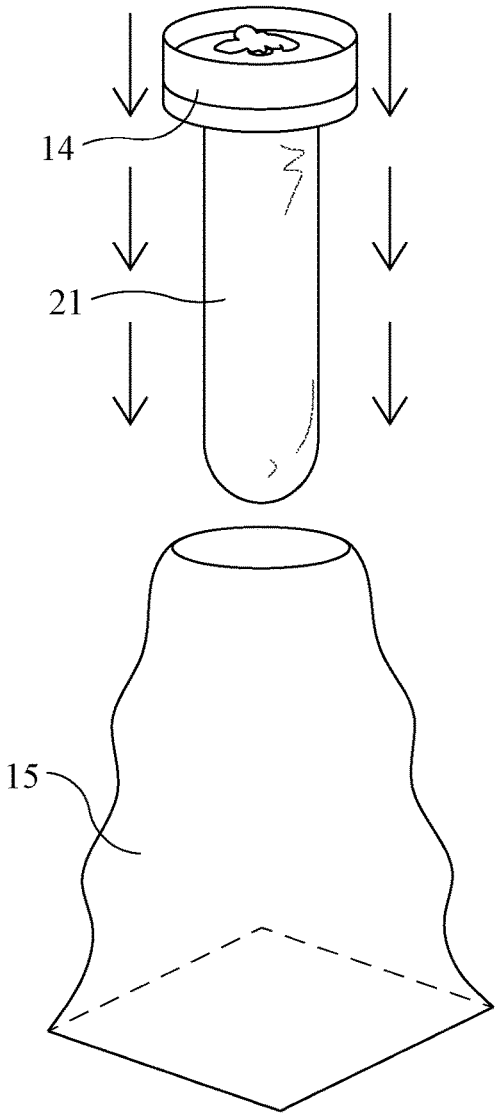
FIG. 31 is a side perspective view of the bottom cosmetic compartment, and the foundation compartment outside of the bottom cosmetic compartment.
Figure 32:
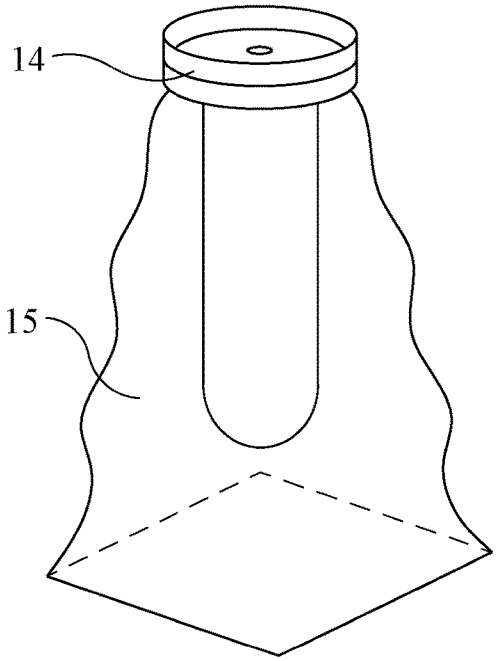
FIG. 32 is a side perspective view of the bottom cosmetic compartment, and the foundation compartment inserted within the bottom cosmetic compartment.
Figure 33:
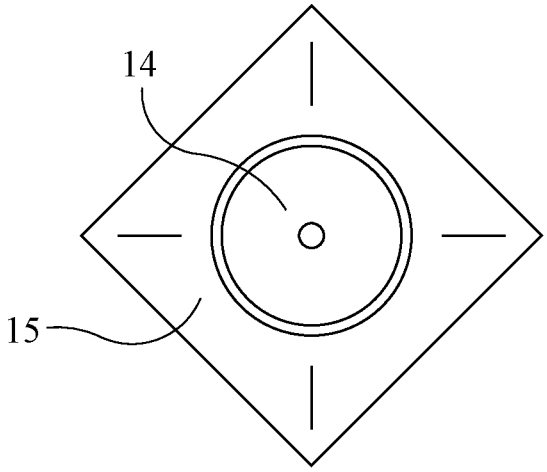
FIG. 33 is a top view of the bottom cosmetic compartment with the foundation compartment inserted therein.
Figure 34:
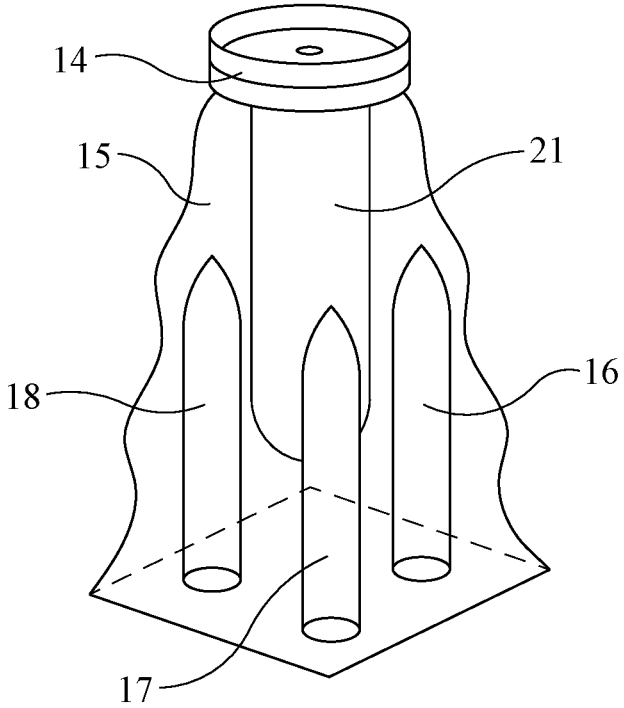
FIG. 34 is a side perspective view of the bottom cosmetic compartment having the foundation compartment, lip liner, eye liner and mascara therein.

Upper compartments 4 may be configured so that each compartment may be accessed. A non-limiting way to be able to access the compartments is to have them attached by and rotatable about a pin through the compartments near an edge of the compartment, as depicted for example in FIG. 23.

FIGS. 25-30 depict a foundation compartment 21, with a lid 14. According to non-limiting embodiments, the foundation may have a pump action dispenser tube 22.

FIGS. 31-34 depict how the foundation compartment 21 may be inserted into the bottom cosmetic storage compartment 15, while also allowing space for other components within the bottom cosmetic storage compartment, such as one or more of lip liner, eye liner, mascara and/or lip gloss. In the depicted embodiment, the foundation lid rests on the edges of the top of the bottom cosmetic storage department and suspends the foundation compartment within the bottom cosmetic storage compartment.

Figure 35:
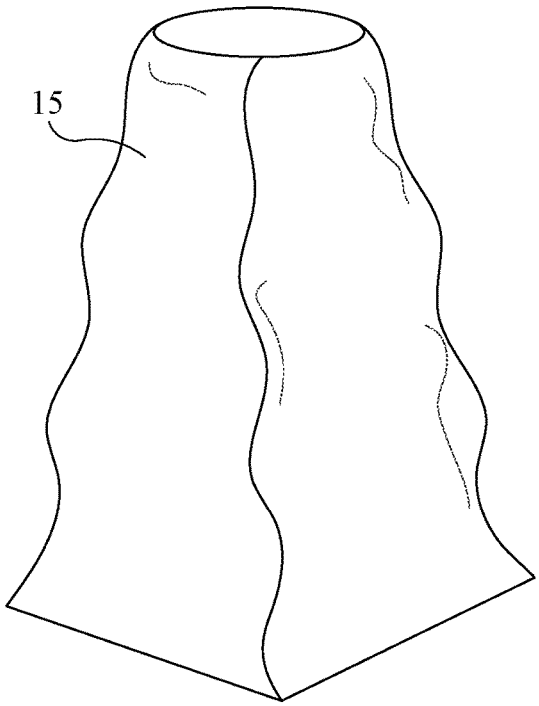
FIG. 35 is a side perspective view of the bottom cosmetic compartment according to example embodiments of the present invention.
Figure 36:
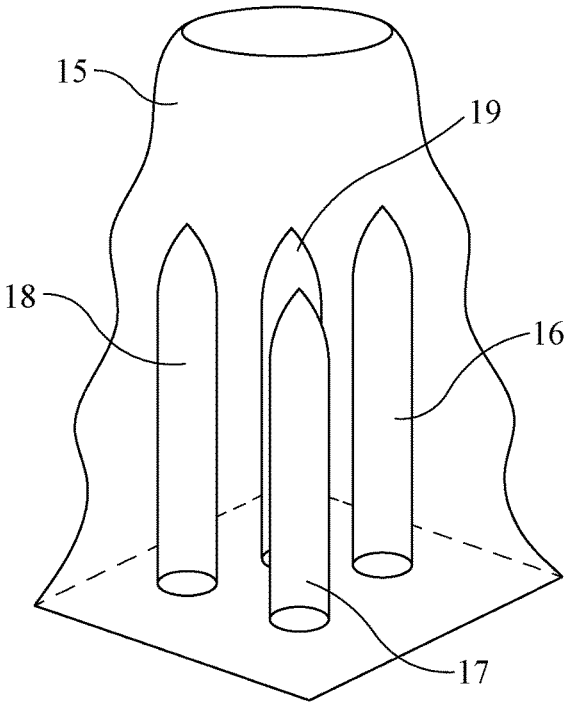
FIG. 36 is a see-through side perspective view of the bottom cosmetic compartment.
Figure 37:
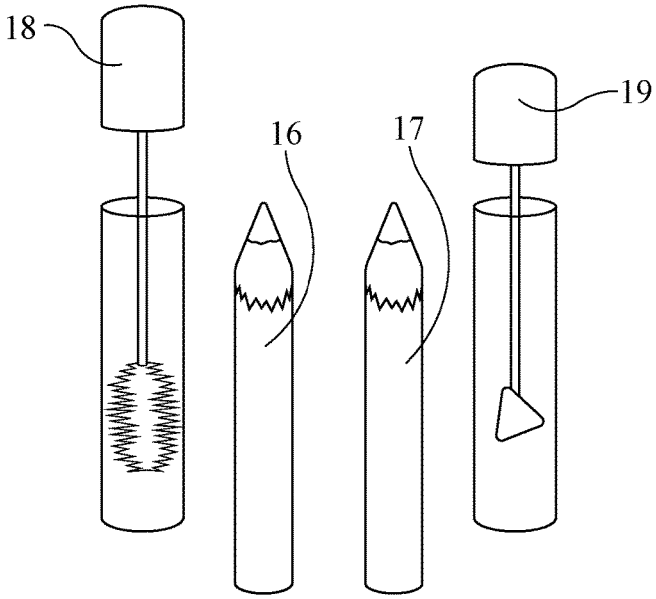
FIG. 37 is a view of the eyeliner, lip liner, mascara, and lip gloss stored inside the bottom cosmetic compartment.
Figure 38:
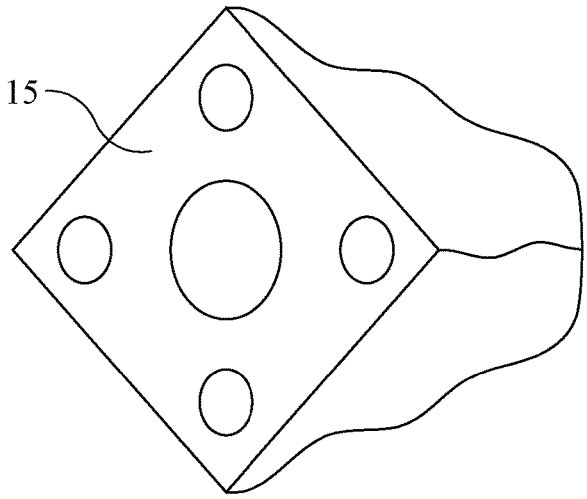
FIG. 38 is an angled bottom view of the bottom cosmetic compartment depicting the storage slots for the eyeliner, lip liner and mascara along with the center push release button.
Figure 39:
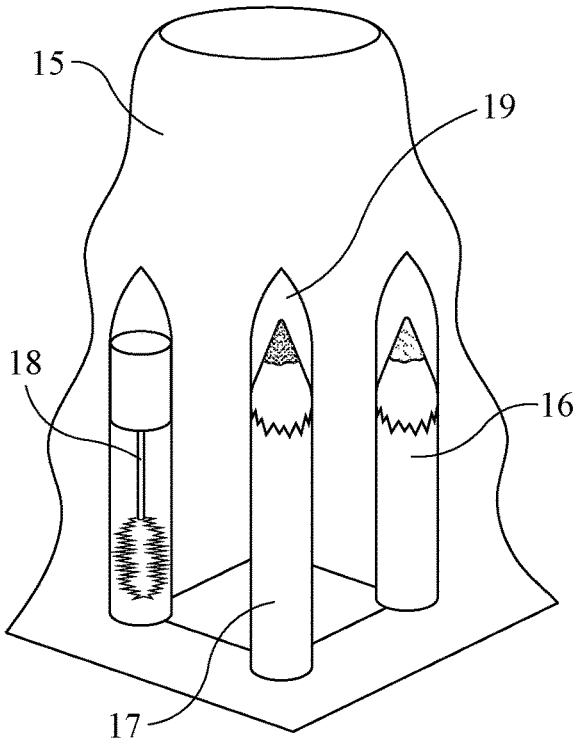
FIG. 39 is a see-through side view of the bottom cosmetic compartment depicting the storage slots for eyeliner, lip liner and mascara.

FIGS. 35-40 depict an example of the bottom cosmetic storage compartment 15 of the present invention having additional cosmetics 16-19 therein. Although FIG. 35 is depicted in a particular shape and color, the present invention is not limited to this shape and color, so long as the bottom storage compartment is at least partially hollow to be able to accommodate cosmetics therein. According to non-limiting example embodiments the cosmetics to be inserted within this portion of the overall device may be more cosmetics that may be e.g., elongated and/or vertically arranged, such as sticks or pencils including for example, lipstick, lip gloss, lip liner, mascara, eyeliner, concealer, etc. By way of non-limiting example, FIG. 37 depicts eyeliner 17, lip liner 16, lip gloss 19 and mascara 18, which may be stored inside the bottom cosmetic storage compartment thereof as depicted for example in FIGS. 36 and 39 (which figures are drawn so one can see inside the storage compartment). FIG. 38 is an angled bottom view of the bottom cosmetic storage compartment depicting the storage slots for the eyeliner, lip liner, lip gloss and mascara, etc. along with the center push release button thereof.

Figure 40:
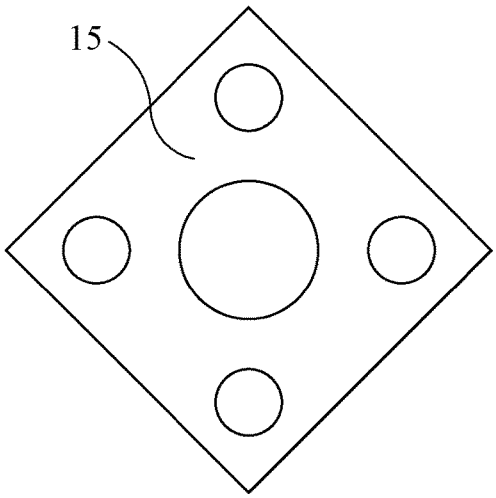
FIG. 40 is a bottom view of the bottom compartment depicting the entry points for the eyeliner, lip liner, mascara slide, and lip gloss for storage along with the center push release button.

FIG. 40 is a bottom view of the bottom cosmetic storage compartment 15 depicting the entry points where the eyeliner, lip liner, lip gloss and/or mascara, or other cosmetics, may slide in for storage. Also depicted is an optional center push release button to release one or more of the cosmetics from the bottom cosmetic storage compartment or to detach the entire base of the bottom cosmetic storage compartment 15 from the rest of the storage compartment. The attachment/release mechanism does not need to be a push button, nor does is need to be round or in the center of the base. Other attachments/release mechanisms may be used that would be suitable for the present purposes.

According to non-limiting example embodiments, the cosmetic components to be inserted in the bottom storage compartment may be all one type (such as different shades of lip liner or lip gloss) or they may be of various types depending on a pre-configured kit by the manufacturer, or they may be selected depending on the desired configuration by the user. They may be selected by the user and/or replaceable when a different color or item is preferred or when one item is used up or expired.

Figure 41:
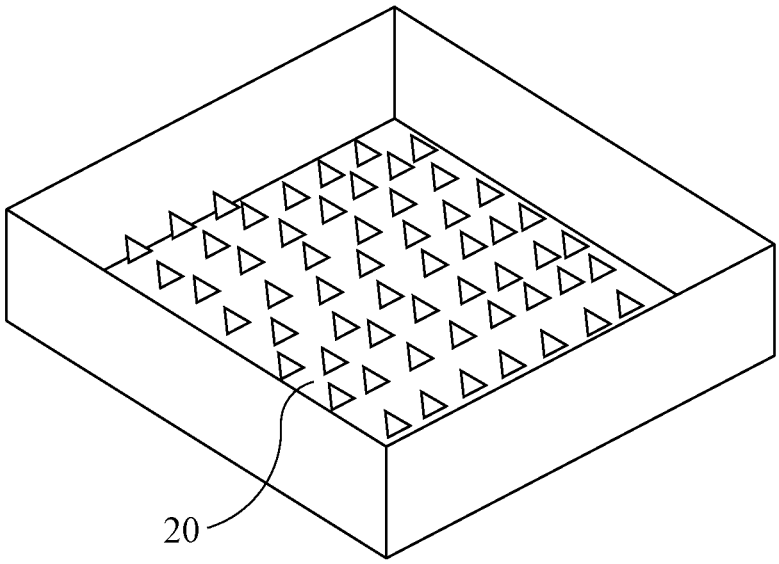
FIG. 41 is an inside perspective view of the silicone bottom cover cosmetic brush cleansing pad according to example embodiments of the present invention.
Figure 42:
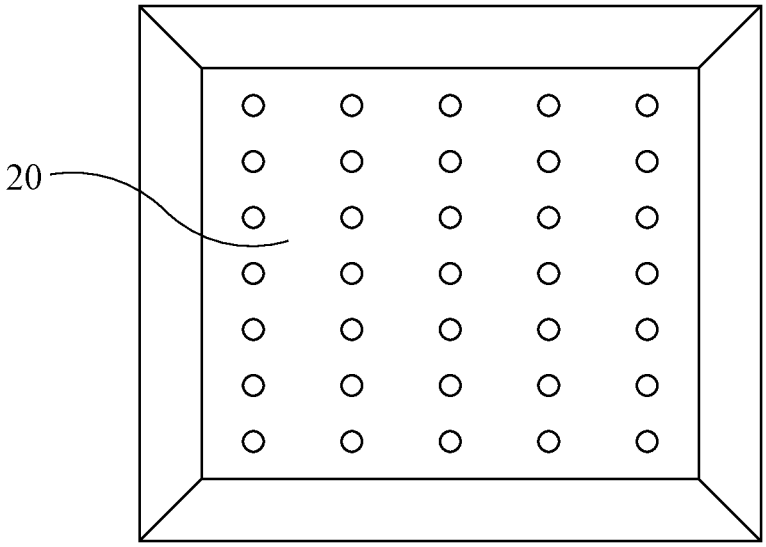
FIG. 42 is a top view of the silicone bottom cover cosmetic brush cleansing pad.

FIGS. 41-44 depict a bottom cover 20 that optionally includes a bottom cover/makeup brush cleansing pad according to non-limiting example embodiments. FIG. 41 depicts a color inside top view of a bottom cover cosmetic brush cleansing pad according to example embodiments. According to non-limiting example embodiments, the bottom cover may be made of silicone. FIG. 42 shows an inside top view of the bottom cover cosmetic brush cleansing pad 20. Although the cosmetic brush cleansing pad 20 is described as being silicone, according to non-limiting embodiments herein, other materials including rubber or non-rubber materials, metals, wood, paper materials or other materials may make up the cleansing pad. The cosmetic brush cleansing pad may include a base with the cleansing pad portion integrated therein for example by virtue of its shape and/or configuration (e.g. having protrusions emerging from the inside base of the bottom cover of the same or different material as the bottom cover 20), or it may have a component that may be removed (for example if it is attached by a detachable or temporary adhesive) and replaced when the cleansing bad becomes dirty or used. Protrusions may be any suitable shape or length for cleaning cosmetic brushes. It is also contemplated that the cleansing pad may be cleaned by wipe or otherwise washable.

Figure 43:
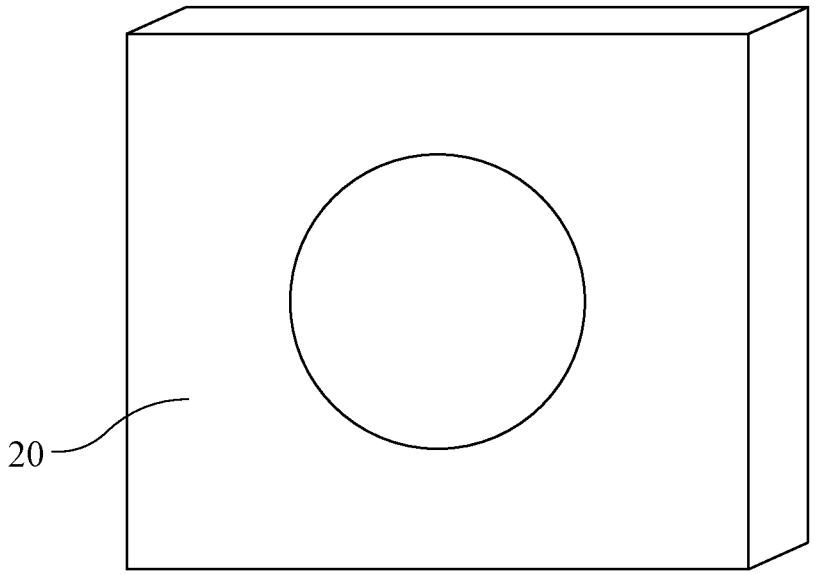
FIG. 43 is a bottom perspective view of the silicone bottom cover cosmetic brush cleansing pad with pop-socket view.
Figure 44:
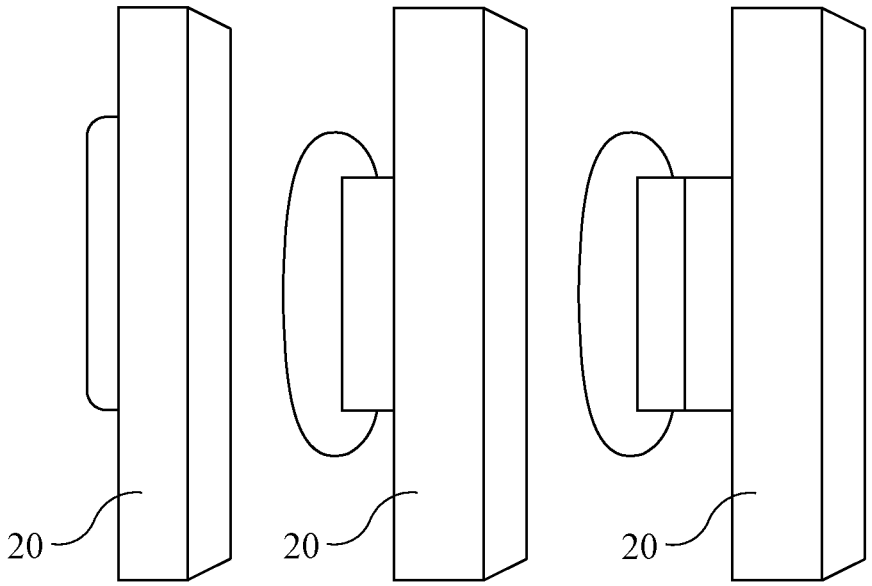
FIG. 44 is a side view of the silicone bottom cover cosmetic brush cleansing pad with pop-socket expanded to three positions (A, B and C).
Figure 45:
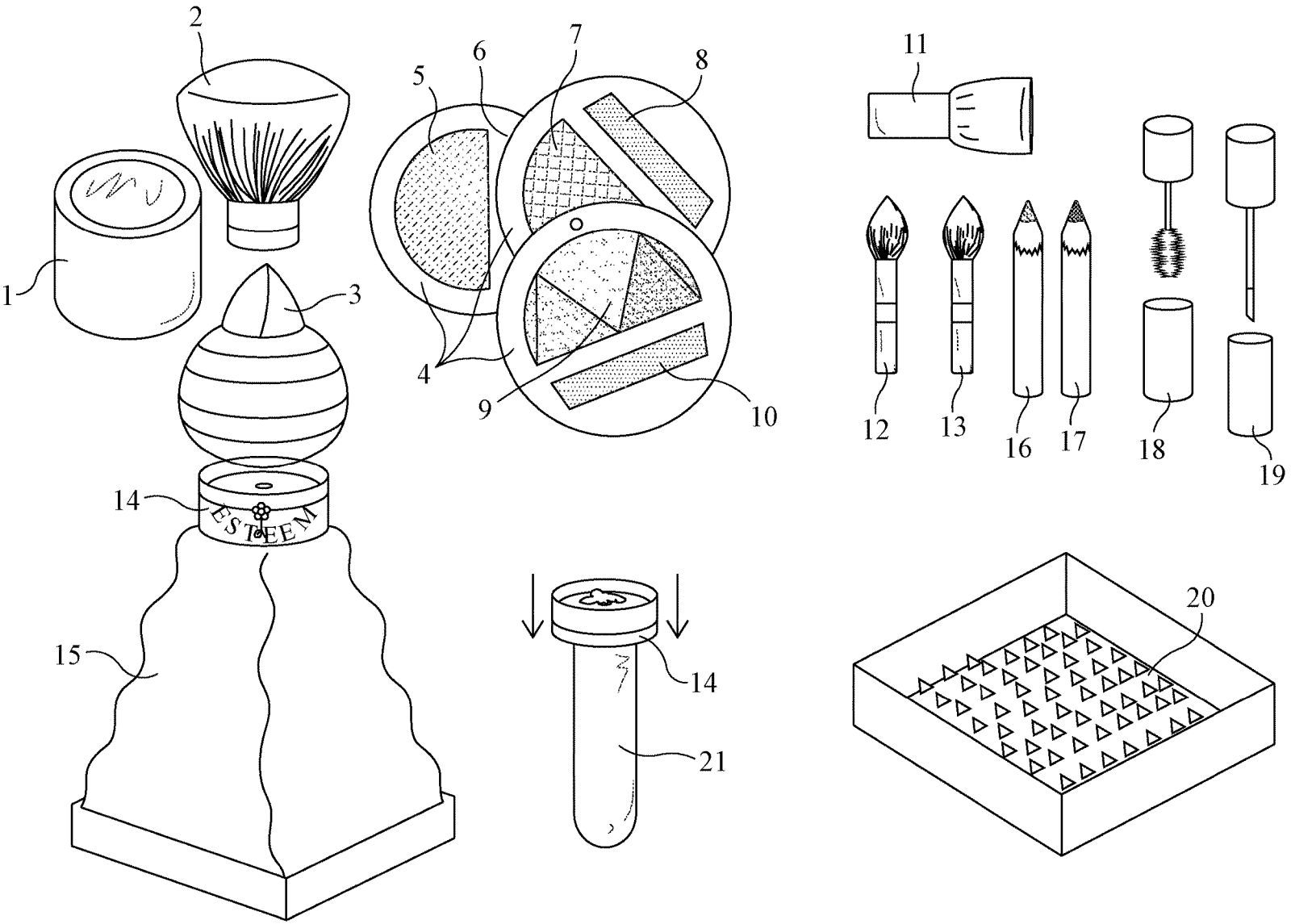
FIG. 45 depicts a non-limiting expanded example of cosmetic device of the present invention.

FIG. 43 is a bottom view of a bottom cover 20 of the present invention. According to this non-limiting example embodiment, a pop socket is included on the bottom of the bottom cover 20. FIG. 44 shows a side view with the pop socket in three different stages of being popped open, the left picture being most closed and the right being most open. The pop socket may be of any suitable shape, size and location on the bottom of the cover 20. The purpose of the pop socket is for a user to be able to easily hold the bottom cover 20 independent from the rest of the device, so that the bottom cover may be firmly held while a brush or other cosmetic component can be rubbed along the inside cleansing pad of the cover. With this purpose in mind, it is contemplated that other holding and/or gripping mechanisms may be used.

In view of the above, it can be seen that the present invention includes, inter alia, an all-in-one cosmetic device system with interchangeable and replaceable cosmetic components. The present system includes a bottom cover cosmetic brush cleansing pad; a bottom cosmetic storage compartment over the bottom cover cosmetic brush cleansing pad, which bottom cosmetic storage compartment is configured to hold at least one cosmetic component selected from the group consisting of eyeliner, lip liner, lip gloss, mascara and foundation; one or more upper cosmetic compartments over said bottom cosmetic storage compartment, which are configured to rotate into an open position, to reveal and allow access to at least one cosmetic component and/or applicator therein; a cosmetic sponge over the top of the one or more upper cosmetic compartments; a cosmetic brush within a sheath over the cosmetic sponge, wherein the cosmetic sponge is retractable into and out of the sheath; and a top cover fitted over the cosmetic brush when the cosmetic brush is in a retracted position.

According to non-limiting example embodiments, the bottom cover cosmetic brush cleansing pad may have a holding apparatus. Example holding apparatuses may include for example a retractable/expandable holding apparatus, such as a popsocket.

According to non-limiting example embodiments, the bottom cover cosmetic brush cleansing pad may be made of flexible silicon.

According to non-limiting example embodiments, the upper cosmetic compartments may include at least one compartment for at least one cosmetic component and/or applicator, selected from the group consisting of eye shadow, blush, lip color, an eye shadow brush, a lip brush and a blush brush. According to further examples, the one or more upper cosmetic compartments may include at least a first upper cosmetic compartment that includes at least one eye shadow component and an eye shadow brush, at least a second upper cosmetic compartment includes at least one lip color component and a lip brush; and at least a third upper cosmetic compartment includes at least one blush component and a blush brush.

According to further example embodiments, the one or more upper cosmetic compartments rotate about a pin arranged through each of the one or more upper cosmetic compartments.

In examples of the present invention, one or more of the bottom cover cosmetic brush cleansing pad, at least one cosmetic component, applicator, cosmetic sponge, cosmetic brush, and a top cover are removable and replaceable components that may be changed out by a user. In further examples, all of the bottom cover cosmetic brush cleansing pad, at least one cosmetic component, applicator, cosmetic sponge, cosmetic brush, and a top cover are removable and replaceable components.

Examples of the present invention may also include a foundation compartment, having a foundation dispensing tube and foundation compartment pump lid. According to non-limiting examples, the foundation compartment is configured to be located within the bottom cosmetic storage compartment. According to further non-limiting examples, the foundation tube extends downward into the bottom cosmetic storage department and is suspended by the foundation compartment pump lid being larger than an opening at the top of the bottom cosmetic storage department.

In non-limiting example embodiments, one or more of the present components may be configured to removably attach to the components adjacent thereto, to prevent the system from falling apart. The attachments may be the same or different than one another. Attachments may be e.g., by friction, a locking mechanism, a non-permanent adhesive, hook and loop fastener, or other attachments known to those skilled in the art.

It is contemplated that components of the present invention may be sold separately or may be available in kits. For example, a "starter kit" may be sold with the customizable cosmetic storage kit that may have no actual cosmetics therein, or a pre-determined set of cosmetics. Individual cosmetic components, inserts, and/or brushes may be sold, and sets of cosmetic components, inserts and/or brushes may be sold. For example, there may be a set of components including primarily eye makeup and/or brushes, or lip makeup and/or brushes. Kits may also be sold that include replacement brush 2 and/or sponge 3. According to other embodiments, certain color combinations may be sold to include for example, more winter colors, or spring colors, or blues or pinks. Any combination is contemplated.

Kits of the present invention may also include a tray, box, bag or other device configured to accept components of the present devices/systems, for example while in use. For example, the present kits may include a tray, bag or box, that has a position for holding the top lid, while the brush is in use, and/or for holding the entire device from the bottom compartment upward, when that portion of the device is listed off the base, for access to e.g., lip liner, mascara, eye liner, lip brush, or other components on the base, that were stored within the bottom cosmetic storage compartment. The tray, bag or box may also have a component for holding the removable bottom cover cleansing pad while it dries after being washed or rinsed, before being added back to the bottom of the present devices or systems.

In view of the above, it is clear that the present invention also includes kits that include an all-in-one cosmetic device system with interchangeable and replaceable cosmetic components as described herein, and further at least one additional component, such as one or more cosmetic products, one or more applicator brushes, and/or a tray, box, bag or other device configured to accept components of the present devices/systems when they are removed from the cosmetic device system.

According to example embodiments components such as the bottom cosmetic storage compartment or the cleansing pad or the upper unit with compartments may be sold separately, as e.g. a replacement for a broken piece or due to desiring a different color, shape or options, such as number of compartments. Any component configured for use with or insertion into the present invention is also contemplated herein.

Components of the present invention may be made of various materials. According to example embodiments, components such as the bottom cosmetic storage compartment, covers and base, may be a rigid or semi-rigid material for stability and/or to hold its shape.

While the present disclosure has been described in terms of exemplary aspects, those skilled in the art will recognize that the present disclosure can be practiced with modifications in the spirit and scope of the application. The examples provided herein are merely illustrative and are not meant to be an exhaustive list of all possible designs, aspects, applications or modifications of the present disclosure.

We claim:

1. An all-in-one cosmetic device system with interchangeable and replaceable cosmetic components comprising:

a bottom cover textured cosmetic brush cleansing pad;

a bottom cosmetic storage compartment over the bottom cover cosmetic brush cleansing pad having protrusions, wherein said bottom cosmetic storage compartment is configured to hold at least one cosmetic component selected from the group consisting of eyeliner, lip liner, lip gloss, mascara and foundation;

one or more upper cosmetic compartments over said bottom cosmetic storage compartment, said one or more upper cosmetic compartments being configured to rotate into an open position, to reveal at least one cosmetic component and/or applicator therein, which allows a user to access said at least one cosmetic component and/or applicator;

a cosmetic sponge over a top of the one or more upper cosmetic compartments;

a cosmetic brush within a sheath over the cosmetic sponge, wherein the cosmetic brush is retractable into and out of the sheath; and a top cover fitted over the cosmetic brush when the cosmetic brush is in a retracted position.

2. The all-in-one cosmetic device system with interchangeable and replaceable cosmetic components of claim 1, wherein said bottom cover cosmetic brush cleansing pad having protrusions has a retractable holding apparatus.

3. The all-in-one cosmetic device system with interchangeable and replaceable cosmetic components of claim 1, wherein said bottom cover cosmetic brush cleansing pad having protrusions, comprises flexible silicon.

4. The all-in-one cosmetic device system with interchangeable and replaceable cosmetic components of claim 1, wherein the one or more upper cosmetic compartments include at least one compartment for at least one cosmetic component and/or applicator, selected from the group consisting of eye shadow, blush, lip color, an eye shadow brush, a lip brush and a blush brush.

5. The all-in-one cosmetic device system with interchangeable and replaceable cosmetic components of claim 4, wherein the one or more upper cosmetic compartments include at least a first upper cosmetic compartment that includes at least a first eye shadow component and an eye shadow brush, at least a second upper cosmetic compartment includes at least one lip color component and a lip brush; and at least a third upper cosmetic compartment includes at least one blush component and a blush brush.

6. The all-in-one cosmetic device system with interchangeable and replaceable cosmetic components of claim 1, wherein the one or more upper cosmetic compartments rotate about a pin arranged through each of the one or more upper cosmetic compartments.

7. The all-in-one cosmetic device system with interchangeable and replaceable cosmetic components of claim 1, wherein one or more of the bottom cover cosmetic brush cleansing pad having protrusions, the at least one cosmetic component, the applicator, the cosmetic sponge, the cosmetic brush, and the top cover are removable and replaceable components.

8. The all-in-one cosmetic device system with interchangeable and replaceable cosmetic components of claim 1, wherein all of the bottom cover cosmetic brush cleansing pad having protrusions, the at least one cosmetic component, the applicator, the cosmetic sponge, the cosmetic brush, and the top cover are removable and replaceable components.

9. The all-in-one cosmetic device system with interchangeable and replaceable cosmetic components of claim 1, further comprising a foundation compartment, having a foundation dispensing tube and foundation compartment pump lid.

10. The all-in-one cosmetic device system with interchangeable and replaceable cosmetic components of claim 9, wherein the foundation compartment is configured to be located within the bottom cosmetic storage compartment.

11. A kit comprising the all-in-one cosmetic device system with interchangeable and replaceable cosmetic components of claim 1, and at least one additional component selected from the group consisting of one or more cosmetic products, one or more applicator brushes, and a container configured to accept components when they are removed from the cosmetic device system.

12. The kit of claim 11, wherein the container comprises a tray, box or bag.

* * * * *